US005269050A

United States Patent [19]

Yewer, Jr.

[11] Patent Number: 5,269,050

[45] Date of Patent: Dec. 14, 1993

[54] CAM TYPE BUCKLE

[76] Inventor: Edward H. Yewer, Jr., 6251 North Highway 63, Hartland, Wis. 53029

[21] Appl. No.: 988,624

[22] Filed: Dec. 10, 1992

[51] Int. Cl.[5] ..... A44B 11/00

[52] U.S. Cl. ..... 24/170; 24/191; 128/876

[58] Field of Search ..... 24/170, 180, 191, 585; 2/321, 338; 128/876; 602/19

[56] References Cited

U.S. PATENT DOCUMENTS

| | | | |
|---|---|---|---|
| 857,864 | 6/1907 | Bowyer | 24/180 |
| 3,063,447 | 11/1962 | Kirsten | 128/876 |
| 3,608,158 | 9/1971 | Bengstsson | 24/170 |
| 4,639,978 | 4/1987 | Boden | 24/191 |
| 4,726,625 | 2/1988 | Bougher | 24/170 |
| 4,843,688 | 7/1989 | Ikeda | 24/170 |
| 5,036,864 | 8/1991 | Yewer, Jr. | 128/876 |

*Primary Examiner*—Victor N. Sakran
*Attorney, Agent, or Firm*—Quarles & Brady

[57] ABSTRACT

A cam type buckle pinches a strap between a transverse blade of a pivotable tongue of the buckle and a laterally and transversely extending surface of a base of the buckle to pinch the strap in the longitudinal direction (the direction the strap extends through the buckle from end-to-end) and so that the frictional force exerted by the strap on the blade where the strap is pinched by the blade against the surface tends to rotate the tongue into a closed position.

6 Claims, 4 Drawing Sheets

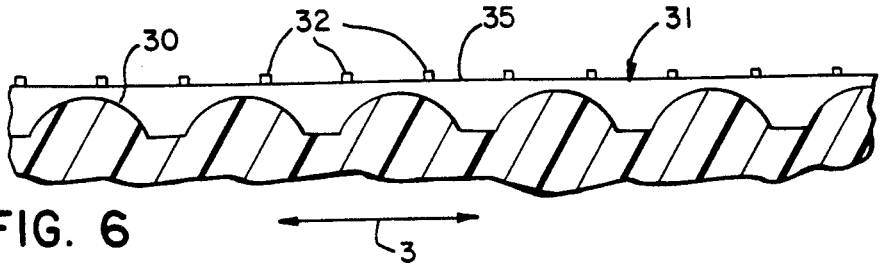
FIG. 6
FIG. 4
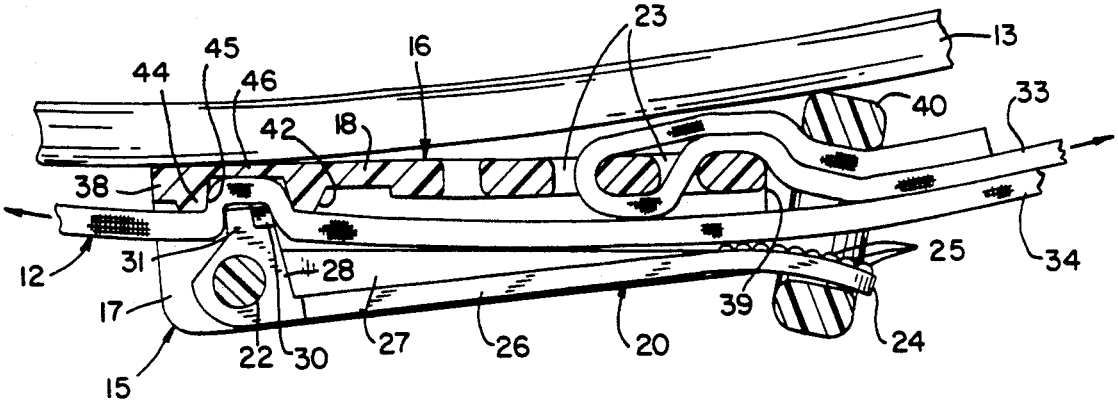
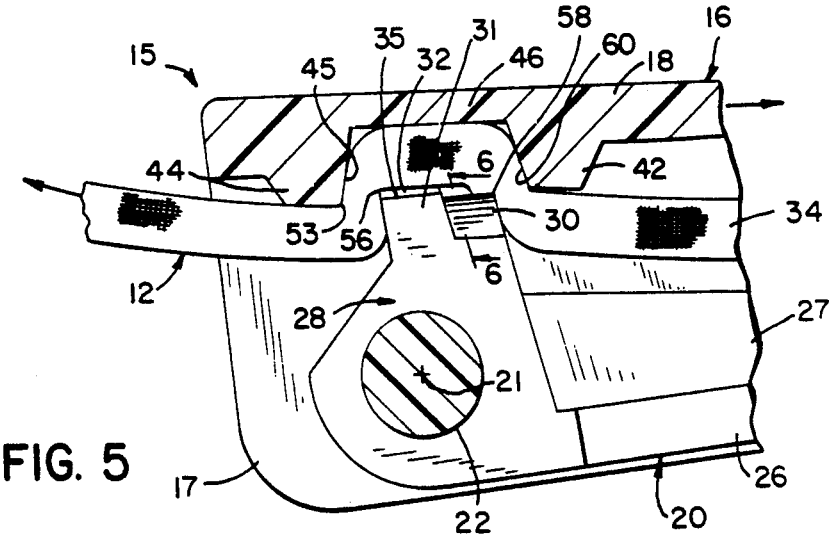
FIG. 5

FIG. 9
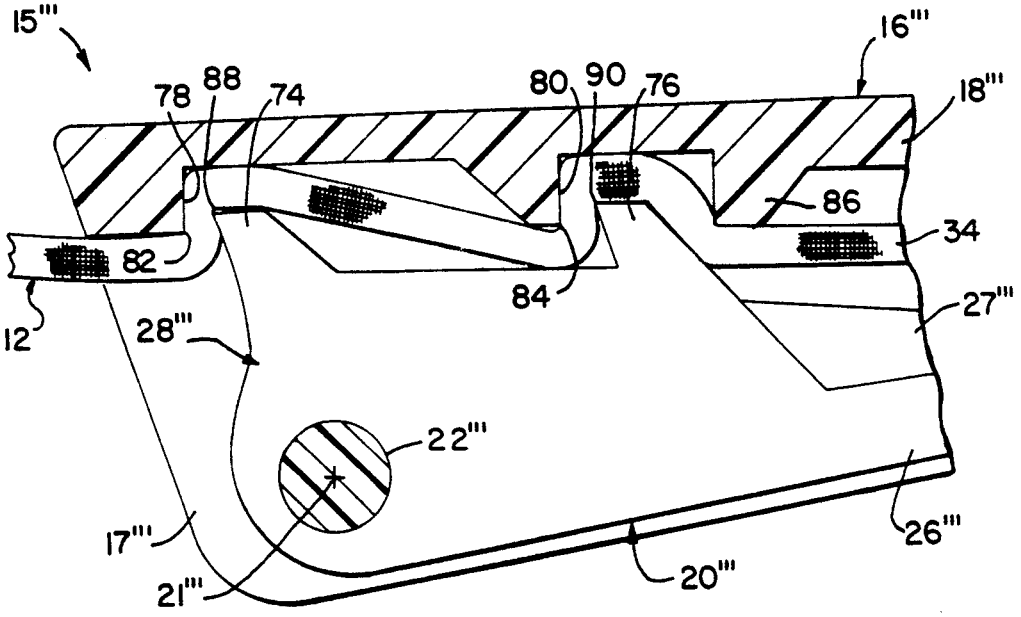
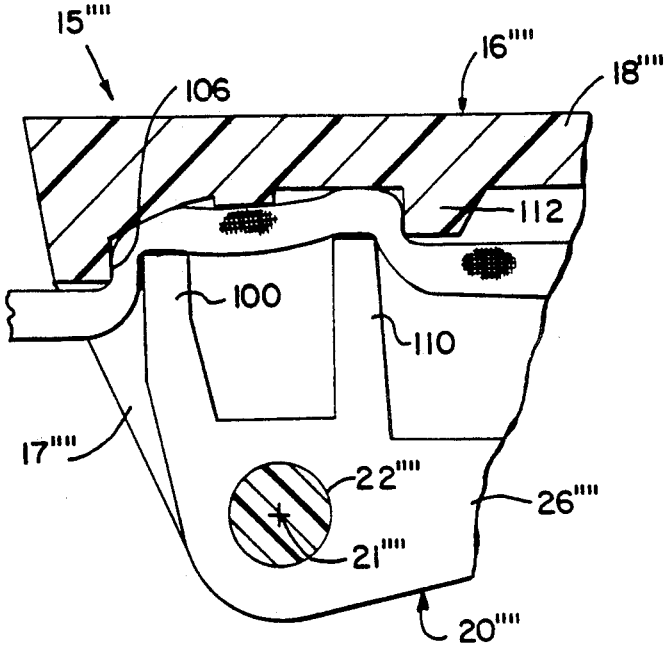
FIG. 10

CAM TYPE BUCKLE

FIELD OF THE INVENTION

This invention relates to a cam type buckle for releasably restraining a strap, such as a woven web, by a frictional engagement therewith. The buckle disclosed has particular applicability to abdominable support belts which are worn by a user to increase the user's strength and load carrying ability or to relieve pain.

BACKGROUND OF THE INVENTION

Prior cam type buckles restrain slippage of the strap by pinching the strap between a transverse blade of a pivotable tongue and the floor of a groove formed in a generally flat base of the buckle. In applications which subject the strap to high levels of compression, the base may bow out under the strain exerted by the blade compressing the belt against the floor of the groove. This limits the pinching force attainable, which limits the tension or cinching force which the belt can hold.

SUMMARY OF THE INVENTION

The invention provides an improved cam type buckle of the type for releasably clamping a strap end between a base of the buckle and a blade of a tongue which is hingedly connected to the base to pivot about a transverse pivot axis. In the improvement, in a clamped position of the tongue the strap is pinched in a longitudinal direction which runs from an entry end of the buckle where the strap end enters the buckle to an exit end of the buckle where the strap end exits the buckle. The strap end is pinched longitudinally to a thickness of less than ninety percent of an uncompressed thickness of the strap and this pinching occurs at a position which is spaced longitudinally toward the entry end of the buckle from the blade. The result is that the base is stressed predominantly in the longitudinal direction, rather than the lateral direction, to reduce or eliminate bowing of the base away from the blade. Pinching the strap end longitudinally at a position which is spaced longitudinally toward the entry end of the buckle from the blade results in the friction force exerted on the blade by the strap, which is primarily directed laterally away from the base, tending to rotate the tongue toward the closed position, thereby tending to further increase the friction force exerted by the blade on the strap.

Many other objects and advantages of the invention will be apparent from the drawings and the detailed description of the preferred embodiments.

BRIEF DESCRIPTION OF THE DRAWINGS

FIG. 4 is a view like FIG. 3 but showing the buckle in a clamped or closed position;

FIG. 5 is a detail view of a portion of FIG. 4;

FIG. 6 is a fragmentary sectional view taken along the plane of the line 6—6 of FIG. 5;

FIG. 9 is a view like FIG. 5 but showing a third embodiment of a buckle of the invention; and FIG. 10 is a view like FIG. 5 but showing a fourth embodiment of a buckle of the invention.

DETAILED DESCRIPTION OF THE PREFERRED EMBODIMENTS

Figure 1:
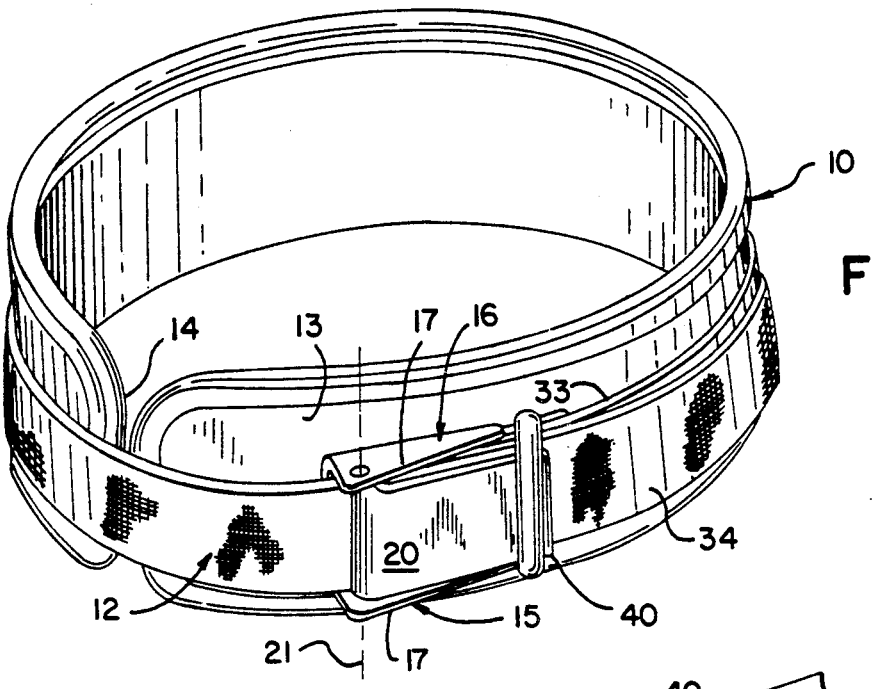
FIG. 1 is a perspective view of an abdominable support belt incorporating a buckle of the invention.
Figure 2:
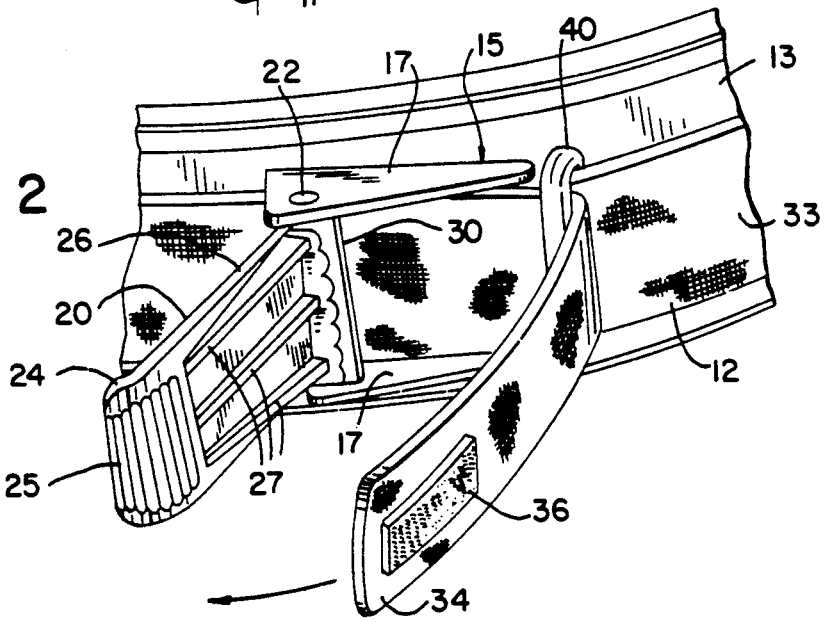
FIG. 2 is a fragmentary perspective view illustrating the belt of FIG. 1 with the buckle in an unclamped or open position and the belt being cinched.
Figure 3:
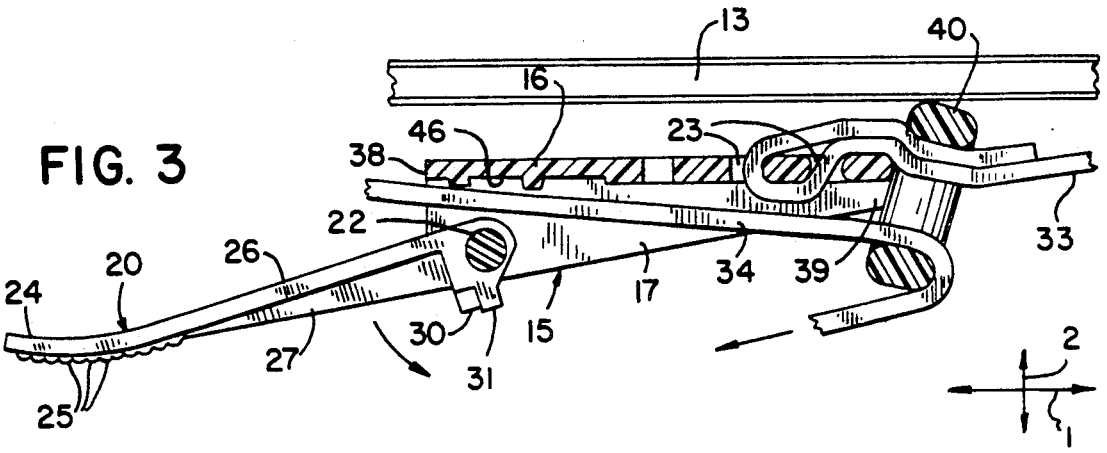
FIG. 3 is a top plan view, partly in section, with the buckle open and the belt being cinched.

Referring to FIGS. 1–3, an abdominable support belt 10 incorporating a cam type buckle 15 of the present invention is illustrated. A belt of this general construction is described and claimed in U.S. Pat. No. 4,782,535 issued to Yewer et al. on Nov. 9, 1988 and in U.S. Pat. No. 5,036,864 issued to Yewer, Jr. on Aug. 6, 1991, the disclosures of which are hereby incorporated by reference.

A supplemental webbing strap 12, preferably made of woven nylon and approximately 2 inches in width, is co-extensive with the body 13 of the belt 10 and extends beyond end 14 so that it can be clamped by the buckle 15, with the strap 12 terminating at free end 34. A piece of Velcro TM 36 is provided on the inwardly facing side of end 34 so that the end 34 can be attached to a mating piece of Velcro TM sewn or otherwise secured on the end 33 of strap 12, which is permanently secured to the buckle 15, so as to secure the other end 34 (i.e., the free end) after the free end 34 is clamped by the buckle 15.

Preferably, the webbing 12 is sewn to the body 13 intermediate its end portions so that when the buckle 15 is released the strap 12 and body 13 stay together as a unit. A torque ring 40 is also preferably provided, as more fully described in U.S. Pat. No. 5,036,864, referenced above.

The buckle 15 is molded in two pieces from a suitable plastic material. In the preferred embodiment, the buckle 15 is molded from fiberglass reinforced nylon. The two pieces which make up the buckle 15 are a base 16 and a manually operated locking tongue 20 which is pivoted to sidewalls 17 of the base by pins 22 which extend transversely from each side of the tongue 20 and are journaled in suitable holes in the sidewalls 17. A bridging portion 18 of the base 16 transversely spans the sidewalls 17. With the pins 22 journaled in the sides 17, the tongue 20 is pivotable about a transversely extending axis 21 which is spaced laterally outwardly from the bridging portion and extends through the centers of pins 22. The pins 22 may be ramped at their ends so as to facilitate snapping the tongue 20 into engagement in the holes in the sides 17. As used herein, the longitudinal direction is identified by arrow 1 (FIG. 3), the lateral direction is identified by arrow 2 (FIG. 3) and the transverse direction is identified by arrow 3 (FIG. 6).

The tongue 20 is preferably provided with an outwardly bent portion 24 that has finger engaging ridges 25 on the inner side thereof near the free end of the tongue 20. A lever portion 26 of the tongue 20 is preferably provided with strengthening integrally molded ribs 27.

The lever portion 26 terminates at its pivoted end in a clamping portion 28 which extends generally perpendicularly from the lever portion 26 so that the tongue 20 is generally L-shaped, with the axis 21 being position approximately at the corner where the two legs of the "L" intersect. The clamping portion 28 extends inwardly from the lever portion 26 (in the clamped position of the buckle as shown in FIG. 4) and is reinforced against angular movement relative to the lever portion 26 by the ribs 27. The ends of the ribs 27 adjacent to the clamping portion 28 terminate in a wall which defines at its laterally inward end a scalloped surface 30 which helps pinch the strap 12 to provide a detent against opening the buckle from the clamped position, as more fully described below.

The clamping portion 28 also includes a blade 31 which extends transversely between the sidewalls 17 and preferably includes transversely spaced apart gripping teeth 32 which extend laterally inwardly from the inward surface 35 of the blade 31. It is the blade 31 (with or without teeth 32) which provides the primary pinching force on the strap 12 to restrain the strap 12 from pulling out of the buckle 15.

Base 16 is secured to strap 12 by free end 33 of strap 12 being threaded through slots 23 and folded and stitched back on itself as best shown in FIG. 3. The bridging portion 18 of the base 16 extends longitudinally from the transverse slots 23 toward the entry end 38 of the buckle 15 where the free end 34 is threaded into the buckle 15, between the bridging portion 18 and the clamping portion 28. The free end 34 exits the buckle 15 at the exit end 39.

Near the entry end 38 a transversely extending detent rib 42 and a transversely extending pinching rib 44 are formed on the bridging portion 18. The ribs 42 and 44 are longitudinally spaced apart and each extends laterally outwardly (toward the tongue when the tongue is closed). A floor portion 46 of the bridging portion 18 extends between the ribs 42 and 44.

Referring now to FIG. 4, it can be seen that in the clamped position of the tongue 20 the detent rib 42 is on the side of the clamping portion 28 in the direction toward the exit end 39 of the buckle 15 and the pinching rib 44 is on the other side of the clamping portion 28, which is in the direction toward the entry end 38. In these positions of the ribs 42 and 44 relative to the tongue 20, the detent rib 42 is angularly spaced about the pivot axis 21 of the tongue 20 from the clamping portion 28 in the angular direction toward opening the tongue 20 and the pinching rib 44 is angularly spaced from the clamping portion 28 in the angular direction toward closing the tongue 20, so that the clamping portion 28 is positioned angularly and longitudinally between the ribs 42 and 44.

It is in the relationship of the blade 31 relative to the pinching rib 44 that the present invention materially differs from the prior art. As best shown in FIG. 5, in the present invention, the minimum spacing between the blade, with or without the teeth 32, and the pinching rib 44 is materially less than the thickness of the strap 12 such that the strap 12 is significantly pinched in the longitudinal direction between the blade 31 and face 45 of the pinching rib 44. In the preferred embodiment, with a strap thickness of from about 0.080 to 0.085 inches, the minimum spacing between face 45 and blade 31 is preferably approximately 0.050 inches, which yields a compression of the strap 12 to a thickness which is approximately 60% of its uncompressed thickness. While in the preferred embodiment the strap 12 is compressed to approximately 60% of its uncompressed thickness in the longitudinal direction (between the blade 31 and the face 45), the invention contemplates longitudinally compressing the strap 12 to any thickness which materially restrains the strap 12 against tensile loads to which it is subjected. It is expected that to materially restrain the strap against tensile loads, the strap 12 must be compressed longitudinally to a thickness which is no greater than 90% of its uncompressed thickness.

Figure 7:
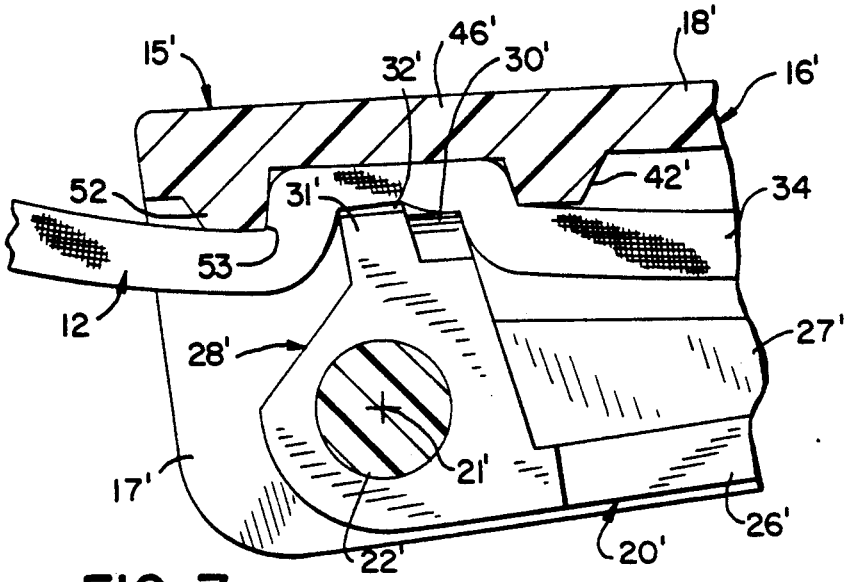
FIG. 7 PRIOR ART
FIG. 7 is a view like FIG. 5 but showing a prior art buckle.

An artist's depiction of a prior art buckle is shown in FIG. 7. In FIG. 7, reference numbers corresponding to reference numbers used to describe the buckle 15 have been used with a prime (') sign. In the prior art buckle 15', the primary pinching force was exerted in the lateral direction on the strap 12 between the blade 31' and the floor portion 46'. When the floor portion 46' was subjected to this loading, it would bow out laterally away from the blade 31', thereby limiting the amount of pinching force which could be exerted upon the strap 12. In the prior art buckles, there was no significant compression of the strap 12 longitudinally between the blade 31' and the rib 52. The rib 52 in the prior art only served to reinforce the bridge portion 18' and require the strap 12 to take a serpentine path through the buckle 15' so that the edge 53 of the rib 52 would help bite into the strap 12 to help restrain it when the strap 12 was subjected to tension pulling it against the edge 53.

By compressing the strap 12 against the face 45 rather than against the floor portion 46 as in a buckle of the invention, the base 16 is able to support much higher compressive loads exerted by the tongue 20. This is because the loading of the base 16 is largely in the longitudinal direction when the strap 12 is pinched against the pinching rib 44, as opposed to being largely in the lateral direction when the strap 12 is pinched against the floor portion 46 as in the prior art buckle 15'. The base 16 is much stronger in the longitudinal direction and therefore able to resist bowing away from the blade in the longitudinal direction up to a much higher load than is the case in the lateral direction.

Pinching the strap 12 against face 45 of the pinching rib 44 rather than the floor portion 46 also enables a more effective angle of attack by the blade 31 on the strap 12. By pinching the strap 12 against the face 45, the blade 31 presents its leading edge 56 to grip into and frictionally engage the outward surface of the strap 12. The frictional forces exerted by the strap 12 on the blade 31 as the strap 12 attempts to slide by the leading edge 53 are directed more toward the pivot axis 21 of the pins 22 than in the case in the prior art where the frictional forces were in a plane which was generally tangential to the axis 21' of the pins 22' at a radius approximately equal to the distance from the axis 21' to the end of the blade 31'. By aggressively biting into the strap 12 at an angle as in the invention, the strap 12 is much less likely to scrape past the blade 31 than it was in the prior art buckle.

In the invention, it is also possible to, in addition to compressing the strap 12 against a laterally extending surface such as face 45, compress the belt 12 against a longitudinally extending surface such as the floor portion 46 in the prior art buckle. Both means of creating friction between the buckle and the strap 12 may be employed to practice the invention, or the belt 12 may not be compressed against a floor surface if desired.

In the invention, as in the prior art, it is desirable to compress the belt 12 between the scalloped edge 30 and the detent rib 42. As the tongue 20 is pivoted into the clamping position shown in FIG. 4, the clamping portion 28 swings past the detent rib 42 and as it does so compresses the strap 12 between the clamping portion 28 and the detent rib 42. The scalloped surface 30 presents a trailing edge 58 which maintains compression of the strap 12 between the trailing edge 58 and the detent rib 42 to bias the tongue 20 toward the clamped position. It is also desirable to employ the torque ring 40 to maintain the tongue 20 in the clamped position as shown in FIGS. 1 and 4.

In addition, the frictional forces exerted by the strap 12 on the tongue 20 as the strap 12 is subjected to tensile forces while the buckle 15 is in the clamped position tend to rotate the tongue 20 toward the clamped position, thereby tending to reduce the minimum spacing between the blade 31 and the pinching rib 44 which, of course, increases the holding capacity of the buckle 10. In this regard, the corner 56 of blade 31 is spaced longitudinally toward the entry end 38 of buckle 15 relative to the pivot axis 21. Thus, a laterally directed frictional force exerted on the corner 56 by the strap 12 being subjected to tension tends to rotate the tongue 20 toward the closed position, as is desirable.

It is also noted that in the closed position (FIGS. 1 and 4), the strap end 34 underlies the lever portion 26, as does the end 33 in the area between the slots 23. Therefore, between the slots 23, two layers of strap 12 space the lever portion 26 from direct contact with the base 16 in the closed position. Since the two layers of strap 12 are compressible in thickness and resilient, the lever portion 26 can be pushed against them and hooked with the torque ring 40 as shown in FIG. 4. In this position, the two layers of strap 12 act somewhat like a spring to bias the lever portion 26 open, which helps hold the torque ring 40 over the end 24 of the lever portion 26. Also, the force exerted on blade 31 by the strap 12 being pinched against face 45, tends to bias the tongue 20 open, which also helps hold the torque ring 40 over the end 24 of the lever portion 26.

Figure 8:
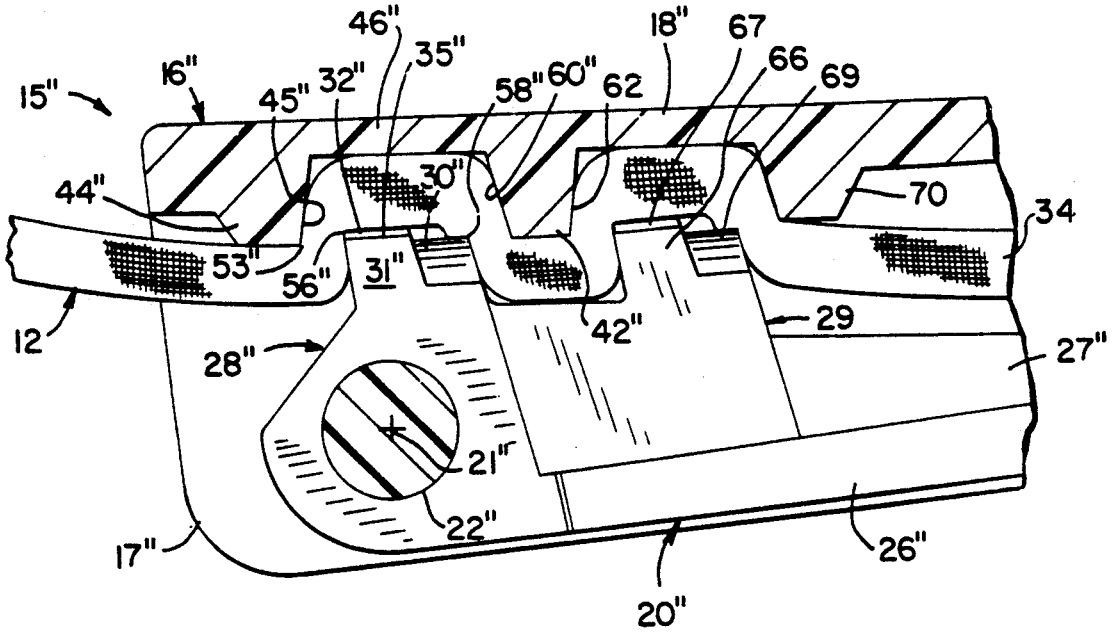
FIG. 8 is a view like FIG. 5 but showing a second embodiment of a buckle of the invention.

FIG. 8 illustrates a second embodiment of a buckle 15'' of the invention. The buckle 15'' is essentially identical to the buckle 15 illustrated in FIG. 5, but has two clamping portions 28' and 29. The first clamping portion 28'' cooperates with the pinching rib 44 and detent rib 42 to restrain the strap 12 against tensile forces in the same way as the clamping portion 28 in the embodiment of FIG. 5. The second clamping portion 29 also operates in the same way. In the buckle 15'', the detent rib 42'' functions at its leading surface 6011 in the same way as the detent rib 42 but at its trailing surface 62 functions to pinch the strap 12 in the manner that the surface 45 of pinching rib 44 does. The blade 66 as shown is provided with teeth 67 identically to the blade 31. The clamping portion 29 also has scalloped surface 69 identical to clamping portion 28, which cooperates with a third rib 70 which functions like the detent rib 42 to pinch the strap 12 between the third rib 70 and the scalloped surface 69. By providing two clamping portions, the ability of the buckle to restrain the strap 12 against tensile forces is increased.

It should be recognized that in the embodiment of FIG. 8 as in the embodiment of FIG. 5, pinching the strap 12 between the scalloped surfaces of the respective clamping portions and the ribs adjacent thereto is optional to help hold the tongue 20 in the clamped position, and does not significantly add to the ability of the respective buckles to hold the strap 12 against tensile loading. Since the frictional forces exerted by the strap 12 on the tongue 20 tend to rotate the tongue 20 in the angular direction toward the clamped position, the spacing behind the respective scalloped surfaces would tend to open, which would reduce the forces restraining the strap 12 in that area.

FIG. 9 illustrates a third embodiment of a buckle 15''' of the invention. In the buckle 15''', the strap 12 is pinched between two transversely extending longitudinally spaced apart blades 74 and 76 and respective laterally and transversely extending surfaces 78 and 80. At the lateral outward extremity of each surface 78 and 80, a respective edge 82 and 84 is presented. No detent is provided for the blade 74, but behind blade 76 a detent rib 86 is provided which pinches the strap 12 between it and the blade 76.

Each of the blades 74 and 76 have respective leading edges 88 and 90 which form acute angles to bite into the strap 12 as the strap 12 is compressed against the respective surfaces 78 and 80. The leading edge 88 is advanced (i.e., positioned toward entry end 38) in the longitudinal direction relative to the pivot axis of the tongue 92 and the leading edge 90 is retarded (i.e., positioned toward exit end 39) relative to the pivot axis. Since the leading edge 88 is advanced in the longitudinal direction relative to the pivot axis of the tongue 20''', the frictional forces exerted by the strap 12 on the blade 74 tend to rotate the tongue 20''' in the angular direction toward the clamping position, which reduces the spacing between the blade 74 and the surface 78 to increase the load holding capacity of the buckle 15'''. On the other hand, the frictional forces exerted by the strap 12 on the leading edge 90 of the blade 76, which act largely in the laterally outward direction, tend to swing the tongue 20''' toward the open position. While the detent provided by rib 86 and the forces acting on blade 74 help to counteract this, a torque ring 40 insures that the tongue 20''' will not open.

A fourth embodiment 15'''' is illustrated in FIG. 10. In this embodiment, the strap pinching function is provided by a blade 100 which is advanced in the longitudinal direction from the pivot axis of the tongue 20'''' (i.e. to the left of the pivot axis 21'''' as viewed in FIG. 10). The blade 100 compresses the strap 12 against surface 106 of the base 16''''. A trailing blade 110 is retarded in the longitudinal direction from the pivot axis 21'''' (i.e. to the right of the pivot axis 21'''' as viewed in FIG. 10) and provides the detent function in cooperation with a rib 112. Therefore, the strap 12 is compressed between the trailing blade 110 and the rib 112 to help hold the tongue 20'''' in the clamped position.

Preferred embodiments of the invention have been described above in detail. Numerous modifications and variations of those embodiments will be apparent to those of ordinary skill in the art. Therefore, the invention should not be limited by the preferred embodiments described, but only by the claims which follow.

I claim:

1. In a cam type buckle for releasably clamping a strap end between a base of the buckle and a blade of a tongue which is hingedly connected to the base to pivot about a transverse pivot axis, the improvement wherein:

in a clamped position of said tongue said strap is pinched to its minimum thickness along a longitudinal direction which runs from an entry end of said buckle where said strap end enters said buckle to an exit end of said buckle where said strap ends exits said buckle to a thickness of less than ninety percent of an uncompressed thickness of said strap, said pinching occurring at a position which is spaced longitudinally toward said entry end from said blade.

2. The improvement of claim 1, wherein said strap is pinched in said longitudinal direction to a thickness of less than seventy percent of said uncompressed thickness of said strap.

3. The improvement of claim 1, wherein said strap is pinched between said blade and an upstanding rib of said base.

4. The improvement of claim 1, wherein said blade has a transverse corner which pinches said strap and said transverse corner is longitudinally spaced from the pivot axis of said tongue in a longitudinal direction toward the entry end of said buckle.

5. The improvement of claim 1, wherein said blade terminates at a laterally inward end and includes teeth formed at said laterally inward end.

6. The improvement of claim 1, further comprising a transversely extending pinching face formed on said buckle which is spaced toward said entry end and said pivot axis, said pinching face having a laterally outer edge, and wherein said blade terminates at a laterally inward end which extends laterally inward of said laterally outward edge of said pinching face.

* * * * *

UNITED STATES PATENT AND TRADEMARK OFFICE

CERTIFICATE OF CORRECTION

PATENT NO. : 5,269,050

DATED : December 14, 1993

INVENTOR(S) : Edward H. Yewer, Jr.

It is certified that error appears in the above-identified patent and that said Letters Patent is hereby corrected as shown below:

In col. 2, line 63, change "position" to --positioned--.

In col. 5, line 42, change "6011" to --60"--.

In claim 1, col. 6, line 59, change "strap ends exits" to --strap end exits--.

In claim 6, col.8, line 6, change "end and said" to --end from said--.

Signed and Sealed this

Twenty-first Day of June, 1994

*Attest:*

Bruce Lehman

BRUCE LEHMAN

*Attesting Officer*

*Commissioner of Patents and Trademarks*